US005931404A

United States Patent [19]

Paucher

[11] Patent Number: 5,931,404

[45] Date of Patent: Aug. 3, 1999

[54] ELECTRIC COIL WITH A LOW VOLTAGE DIFFERENTIAL BETWEEN ADJACENT WINDINGS

[76] Inventor: AiméPaucher, 86, Chemin du Cellier, VIF, France, 38450

[21] Appl. No.: 08/849,971

[22] PCT Filed: Oct. 16, 1996

[86] PCT No.: PCT/FR96/01621

§ 371 Date: Aug. 7, 1997

§ 102(e) Date: Aug. 7, 1997

[87] PCT Pub. No.: WO97/15937

PCT Pub. Date: May 1, 1997

[30] Foreign Application Priority Data

Oct. 20, 1995 [FR] France ..... 95 12601

[51] Int. Cl.[6] ..... H01F 41/02

[52] U.S. Cl. ..... 242/445.1; 140/92.2; 242/447.3

[58] Field of Search ..... 140/92.2; 242/443, 242/445.1, 447, 447.3, 535.1, 910

[56] References Cited

U.S. PATENT DOCUMENTS

| | | | |
|---|---|---|---|
| 1,813,994 | 7/1931 | George | 140/92.2 |
| 2,263,500 | 11/1941 | Hutchinson et al. | 242/447 |
| 2,930,014 | 3/1960 | Van Der Hoek et al. | 140/92.2 |
| 3,216,671 | 11/1965 | Rahn | 242/910 |
| 3,750,719 | 8/1973 | Goldman et al. | 140/92.2 |
| 5,167,063 | 12/1992 | Hulsink | 242/445 |

FOREIGN PATENT DOCUMENTS

| | | | |
|---|---|---|---|
| 518737 | 12/1992 | European Pat. Off. | H01F 27/28 |
| 518737 | 1/1995 | European Pat. Off. | H01F 27/28 |

*Primary Examiner*—Katherine Matecki
*Attorney, Agent, or Firm*—Arthur L. Plevy

[57] ABSTRACT

The present invention relates to a coil including a plurality of layers of windings wound around an axis. The layers are radial and alternately wound from the inside to the outside and from the outside to the inside.

8 Claims, 3 Drawing Sheets

ELECTRIC COIL WITH A LOW VOLTAGE DIFFERENTIAL BETWEEN ADJACENT WINDINGS

FIELD OF INVENTION

The present invention relates to the winding of electric coils, such as high voltage transformer coils. The present invention more specifically aims at a specific winding enabling to avoid insulation problems between two adjacent windings of two successive layers.

BACKGROUND OF INVENTION

An electric coil generally includes axial winding layers, that is, each layer includes windings wound next to one another parallel to the coil axis. Most often, the coil includes many more windings in the axial direction than in the radial direction.

A disadvantage of such a coil is that two adjacent windings of two successive layers can be separated by a large number of turns, so that they are submitted to a voltage differential which is too high for the insulator of the windings, generally an enamel. Insulator layers thus have to be interposed between the layers of windings, which makes the coil more bulky and its fabrication more complex.

To avoid this disadvantage, in European patent application 0518737, it is provided to wind the windings in oblique layers. A coil obtained by this method has the disadvantage of being bulky since it has a trapezoidal cross-section which necessarily implies that the external diameter of the coil is larger, for a given number of windings, than that of a coil with a rectangular cross-section. The bulk of the coil is further increased by the fact that it includes a large number of crossing windings which hinder a contiguous disposition of the windings.

Due to the many winding crossings, this winding method is not applicable to conductors with a large diameter or a rectangular cross-section.

SUMMARY OF INVENTION

A device for winding coils including a plurality of layers of windings wound around an axis, the layers being radial and wound alternately from an inside to an outside and from the outside to the inside, including: internal and external winding guides distributed in a plane of a layer of windings being wound; means for enabling the external guides to be retracted from an engaged position with the internal guides so as to follow the external diameter of a layer being wound from the inside to the outside, and the internal guides to be retracted from an engaged position with the external guides so as to follow the internal diameter of a layer being wound from the outside to the inside; a fixed guiding means to bring a conductor to be wound into the plane of the winding guides and to hold a first surface of the layer being wound; and a shifting mechanism for axially shifting a completed layer into a hopper at the side opposite the guiding means.

An object of the present invention is to provide a coil with a low bulk and avoiding insulation problems between two adjacent windings of successive layers.

To achieve this object, the present invention provides a coil including a plurality of layers of windings wound around an axis, the layers being radial and wound alternately from the inside to the outside and from the outside to the inside.

According to an embodiment of the present invention, the coil conductors have a rectangular cross-section.

According to an embodiment of the present invention, the main axis of the rectangular cross-section of the conductors is perpendicular to the coil axis.

According to an embodiment of the present invention, the coil conductors have a circular cross-section, each layer including the same number of windings as the preceding layer and being radially shifted with respect to the preceding layer by one conductor half-diameter.

According to an embodiment of the present invention, each winding of the coil includes several conductors in the plane of the associated layer.

The present invention also aims at a device for winding coils of the above-mentioned type. The device includes internal and external turning guides distributed in the plane of a layer of windings being wound. The external guides are retractable from an engaged position with the internal guides so as to follow the external diameter of a layer being wound from the inside to the outside. The internal guides are retractable from an engaged position with the external guides so as to follow the internal diameter of a layer being wound from the outside to the inside. A fixed guiding means brings a conductor to be wound in the plane of the turning guides and maintains a first surface of the layer being wound. A mechanism is provided to perform an axial shifting of a completed layer to a hopper on the side opposite the guiding means.

According to an embodiment of the present invention, the guiding means and the shifting mechanism include together a plurality of rollers with a radial axis distributed on the first surface of the layer being wound, these rollers being provided to axially penetrate between the external and internal turning guides to shift a completed layer.

According to an embodiment of the present invention, the hopper includes a plate for maintaining the wound layers at the side opposite to the guiding means, this plate being axially retractable upon pushing of each completed layer.

The foregoing objects, features and advantages of the present invention will be discussed in detail in the following non-limiting description of specific embodiments in relation with the accompanying drawings.

DETAILED DESCRIPTION OF THE INVENTION

Figure 1:
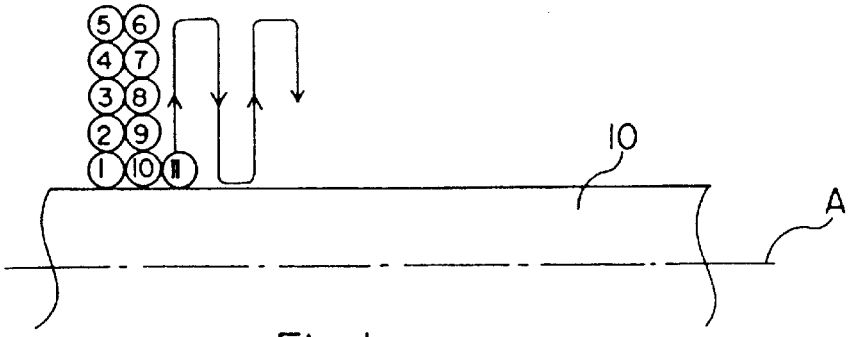
FIG. 1 schematically illustrates a coil according to the present invention under construction.

FIG. 1 shows a cylinder 10 with an axis A, around which a coil should be wound. According to the present invention, the coil is implemented in radial layers, that is, each layer includes several windings successively wound in a same plane perpendicular to axis A of the coil. In FIG. 1, the winding order of the windings is indicated by increasing numbers starting from 1.

Moreover, according to an aspect of the present invention, the layers are wound alternatively from the inside to the outside and from the outside to the inside. For example, in FIG. 1, the first layer includes five windings wound from the inside to the outside. After winding the last winding 5, the first winding 6 of the following layer is wound next to winding 5 and the following windings 7 to 10 are wound towards the inside (that is, towards axis A) starting from winding 6.

With this configuration, the number of turns separating two windings of two adjacent layers is lower than twice the number of windings in the radial direction. Most of the time, the ratio between the number of windings in the radial direction and the number of windings in the axial direction is so low that it is no longer necessary to lay an insulator between the successive layers.

Further, the cross-section of the coil obtained is rectangular and thus has an optimal bulk.

The alternate winding towards the outside and towards the inside enables one to obtain a natural and automatic transition from one layer of windings to the next in such a way that the layers are contiguous.

Figure 2A:
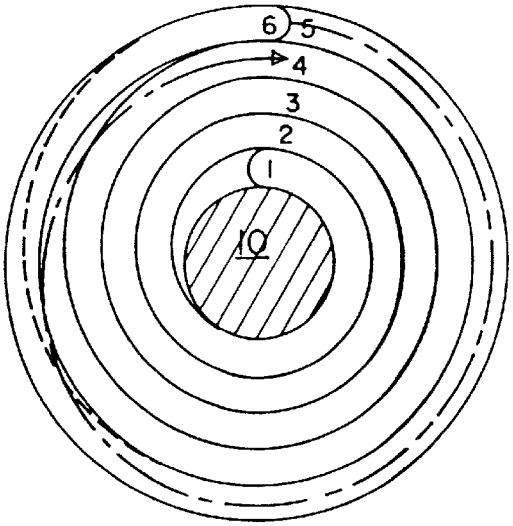
FIGS. 2A and 2B show a front view and a side view of a layer of windings according to the present invention and the starting of the next winding layer.
Figures 2B, 2C:
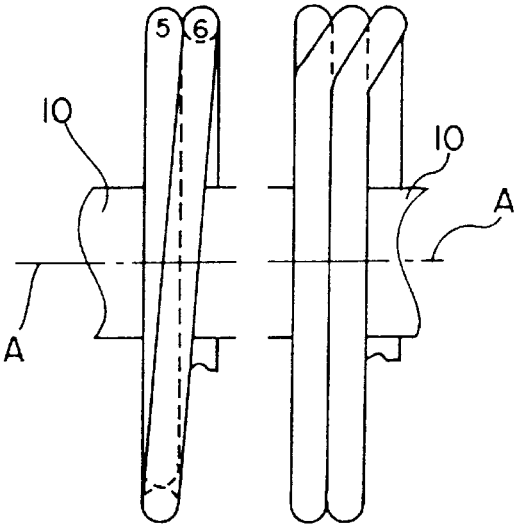
FIG. 2C shows, in a side view, several winding layers according to the present invention, such as they are formed in practice.

FIGS. 2A and 2B show a front view and a side view of a first layer of windings according to the present invention and of the beginning of a second layer of windings. The successive windings 1 to 5 form a spiral rather than a succession of circles, especially when the diameter of the conductor used is large. Thus, the penultimate winding 4 of the first layer progressively reaches, as shown in dotted lines in FIG. 2A, the external diameter of the coil. The last winding 5 remains in the plane of windings 1 to 4 until it reaches the point (at the bottom) where winding 4 starts progressively reaching the external diameter. From this point, winding 5 inscribes in the external diameter by progressively passing next to winding 4 until it ends in the plane of the second layer of windings which starts with winding 6 (at the top).

As shown in mixed lines in FIG. 2A, winding 6 inscribes in the external diameter by passing next to winding 5 down to the point (at the bottom) where winding 5 starts its lateral transition to the second layer. From this point, winding 6 progressively shifts to the inside, while remaining in contact with the first layer, to initiate a spiral going progressively to cylinder 10.

FIGS. 2A and 2B correspond to a theoretical case. The progressive transition from winding 5 to winding 6, the beginning of which has been shown at the bottom of FIGS. 2A and 2B, is in fact abrupt and starts later, practically at the beginning of the layer (at the top of FIGS. 2A and 2B).

FIG. 2C illustrates several transitions from one layer to the next, such as they appear in reality. These transitions are due to the fact that the space shown as empty between cylinder 10 and the end of winding 1 is in fact filled by the end of winding 1; the spiral is flattened in the upper left quadrant in FIG. 2A.

If the conductor used for winding has a rectangular cross-section, the transitions from a layer of windings to the next can only be abrupt, even in theory. These abrupt transitions cause of course no disadvantage, since the layers of windings remain contiguous.

Figure 3A:
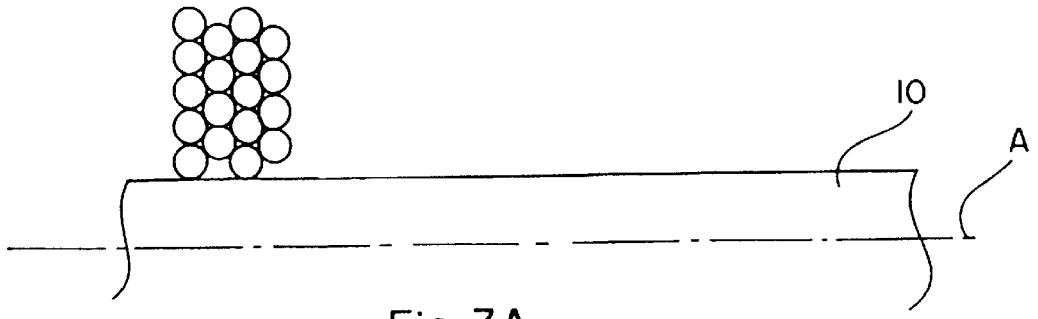
FIGS. 3A–3C schematically show several alternative winding layers according to the present invention.
Figure 3B:
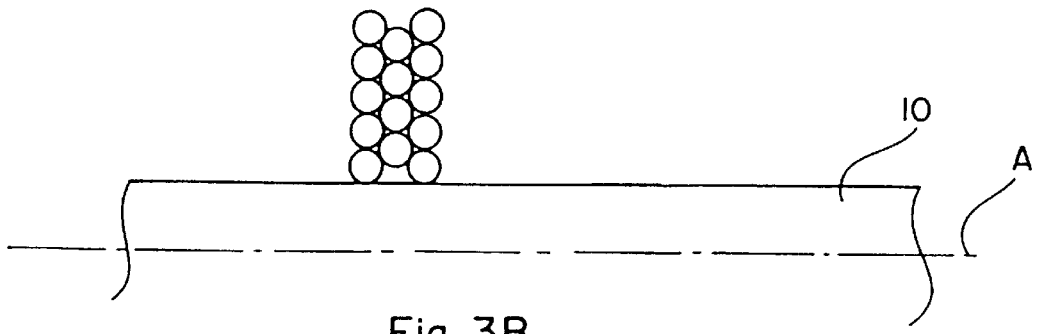
Figure 3C:
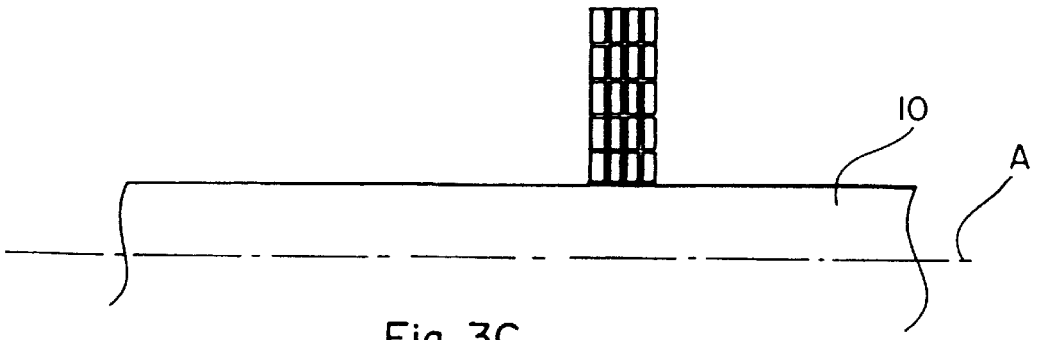

FIGS. 3A–3C illustrates three practical alternatives of a coil implemented according to the present invention.

When a conductor with a circular section is used, as shown as an example in the preceding drawings, the windings actually tend to shift radially by one half-diameter from one layer to another to find a stable position. A coil according to the present invention may then have two alternative configurations illustrated in FIGS. 3A and 3B.

According to a first alternative, layers including a given number of windings are separated by layers including one winding less and shifted by one conductor half-diameter to the outside.

According to the second alternative, the layers include the same number of windings but they are alternately shifted to the outside and to the inside by one conductor half-diameter.

The shifting of the windings from one layer to the next causes a decrease of the axial bulk of the coil, the length of the obtained coil being slightly lower than the number of axial windings of the coil multiplied by their diameter. However, this bulk reduction is not uniform since, in a certain position, each winding of a layer crosses two windings of the preceding layer in the first alternative (FIG. 3A) or one winding of the preceding layer in the second alternative (FIG. 3B). Thus, the bulk reduction does not occur in the crossing areas, which causes an irregularity of the cross-section of the coil. The second alternative (FIG. 3B), which will provide a less irregular cross-section, will be preferred.

As illustrated in FIG. 3C a coil obtained by means of a conductor with a rectangular cross-section is partially illustrated. With a conductor having a rectangular cross-section, the above-mentioned problems disappear. A coil with a perfectly rectangular cross-section is obtained. Preferably, as shown, the main axis of the rectangular cross-section is perpendicular to axis A of the coil. This facilitates the winding process at the transitions from one layer to the next.

Figure 4:
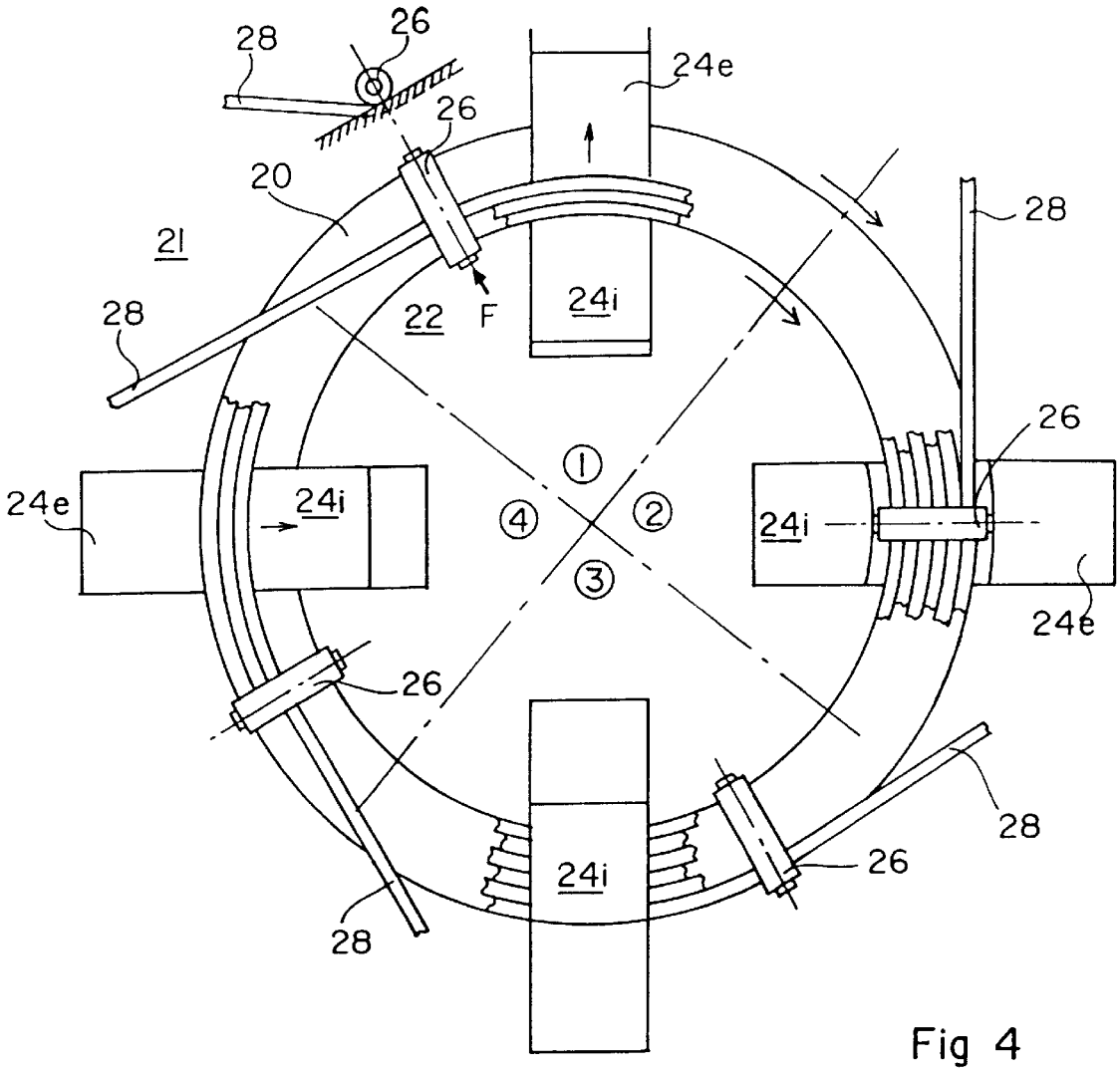
FIG. 4 shows a front view of a winding device according to the present invention, divided into sectors corresponding to winding steps.

FIG. 4 shows a device for fabricating coils with radial layers according to the present invention. The device is shown at four different winding steps, numbered from 1 to 4.

The device includes a ring-shaped spacing 20 in which is wound each radial layer of windings. This spacing 20 is limited between an external plate 21 and an internal plate 22 located in a same plane. External plate 21 includes a plurality of external guides 24*e* distributed at the external circumference of ring-shaped spacing 20. The internal ends of guides 24*e* are arcuate with a diameter substantially equal to the external diameter of ring-shaped spacing 20. Similarly, several internal guides 24*i* are distributed at the circumference of internal plate 22 in correspondence with external guides 24*e*. The ends of guides 24*i* are arcuate with a diameter substantially equal to the internal diameter of ring-shaped spacing 20. Each of guides 24 is likely to slide between an open position of ring-shaped spacing 20 and a closed position of this spacing.

A plurality of rollers with a radial axis 26 are distributed on ring-shaped spacing 20 and roll on a surface of a layer of windings being wound. Of course, for rollers 26 not to be disturbed in their rolling, the guides 24 are arranged in deep enough grooves.

In an initial step, not shown, at the beginning of the winding of a layer from the inside to the outside, the internal guides 24*i* are retracted radially to define the internal diameter of the layer, and the external guides 24*e* are engaged with the corresponding internal guides 24*i*. The internal diameter may be chosen at any value, higher than the diameter of plate 22.

At step 1, plates 21, 22, and guides 24 are rotated, clockwise in FIG. 4, while rollers 26 remain fixed and roll on the edges of ring-shaped spacing 20.

A conductor 28 to be wound arrives tangentially to ring-shaped spacing 20 at the level of one of rollers 26 which rectifies conductor 28 to bring it in the plane of plates 21 and 22, that is, in the plane of the layer being wound. Conductor 28 has to be rectified since, as shown in a local view according to an arrow F, conductor 28 arrives with an inevitable angle of incidence with respect to plates 21 and 22.

As the plates turn, the windings accumulate in spacing 20 from the outside to the inside thanks to the tension of conductor 28 and to the fact that rollers 26, in sufficient number, maintain the windings in spacing 20, preventing the winding being formed from crossing the winding previously formed. Each time an external guide 24*e* passes under the roller 26 at which arrives conductor 28, this guide 24 is pushed back to the outside by one step by the new winding being formed.

Figure 5A:
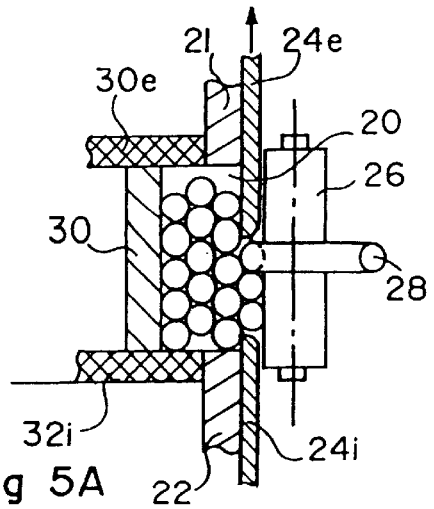
FIGS. 5A and 5B show cross-sectional side views of a portion of the device of FIG. 4 for two winding steps.

FIG. 5A illustrates a partial cross-sectional view of the device of FIG. 4 at step 1. This FIG. 5A shows layers of previously wound windings, which have been piled up in a hopper located at the bottom of ring-shaped spacing 20, behind the layer being wound. These previously wound layers are maintained against the layer being wound and against guides 24 by a plate 30. The combined action of hopper plate 30, of guides 24, and of rollers 26 maintains the wound layers flat.

As shown, guides 24 have a thickness lower than the diameter of the conductor to be wound, which helps rollers 26 maintain flat the layer being wound. The winding being wound has no other possibility than forming radially by pushing back guide 24*e*. Preferably, guides 24 include chamfers which help their pushing away by the winding being formed. The previously wound layers are stored by any adequate means, for example between an internal cylinder 32*i* and an external cylinder 32*e* added at the back of plates 21 and 22, and turning therewith. Such cylinders, generally in cardboard, are currently used to manipulate large size coils.

In step 2 shown in FIG. 4, the last winding of the layer has just been formed. The external diameter reached may be chosen at any value, lower than the internal diameter of plate 21. The layer just wound has to be pushed back into the hopper located at the back. For this purpose, for example, the guide pairs 24*i* and 24*e* are brought in correspondence with rollers 26 and guides 24*i* and 24*e* are sufficiently spaced from one another to enable rollers 26 to penetrate into ring-shaped spacing 20 and thus push back into the hopper the layer which has just been wound.

Figure 5B:
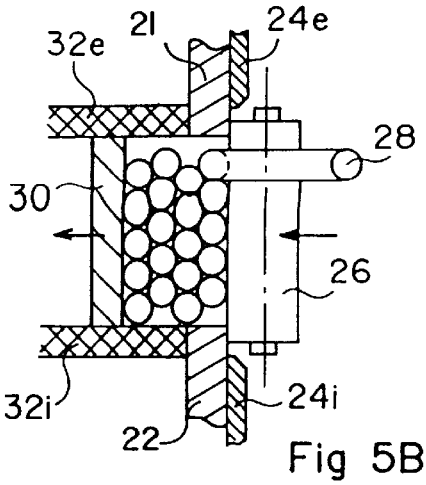

FIG. 5B illustrates this operation in a cross-sectional side view. At the same time as roller 26 pushes back the last wound layer, plate 30 of the hopper is of course released to enable this pushing back.

According to an alternative, plate 30 is fixed and the turning plates 21, 22 and guides 24 altogether are shifted by one conductor diameter, to the right on FIG. 5B.

In step 3 shown in FIG. 4, rollers 26 have recovered their initial position, external guides 24*e* are brought to a position defining the external diameter of the new layer, and internal guides 24*i* are engaged with external guides 24*e*. The guides 24 so placed prevent the last wound layer from undoing itself. To avoid its undoing as rollers 26 join their initial position and before guides 24 can be installed, these operations are performed in at least two passes. In a first pass, they are performed in the even sectors of the turning plates while the layer is maintained in place in the odd sectors. In the second pass, the operations are performed in the odd sectors, the layer being maintained in the even sectors.

In step 4, a layer is being wound from the outside to the inside from the state of step 3. As in step 1, plates 21, 22, as well as guides 24 are rotated clockwise. Each time a pair of guides 24 passes under the roller 26 at which conductor 28 is supplied, internal guide 24*i* is pushed back by one step to the inside by the new winding being formed.

In fact, in this winding step, the windings are wound around internal guides 24*i*. It can thus be remarked that a relatively large number of internal guides 24*i* should be provided to cover as best as possible the internal diameter of ring-shaped spacing 20. Indeed, undesired straight portions always form in the windings in the sectors not covered by adjacent guides 24*i*.

Once the desired internal diameter is reached, the layer which has just been wound is pushed back into the hopper in the way described in relation with steps 2 and 3, internal guides 24*i* being then positioned to determine the internal diameter of a new layer to be wound, and external guides 24*e* being brought into engagement with internal guides 24*i*. Steps 1 to 4 are then repeated.

Preferably, all the moving components of the device are controlled by jacks, for example, pneumatic or electric jacks. By stopping the power supply of the jacks of guides 24, the position of these guides is ensured with a relatively large rigidity. At steps 1 to 4, the jack associated with the guide which is to be pushed back by the winding being formed is released. The release position is determined, for example, by a sensor which detects the coming of the roller 26 at which conductor 28 is supplied.

Similarly, the jack of the plate of hopper 30 is moved as roller 26 pushes back the last wound layer.

Many alterations and modifications of the present invention will occur to those skilled in the art. For example, if there is room between the pairs of guides 24, rollers 26 can be arranged to push back the successive layers into the hopper elsewhere than at the pairs of guides 24, so that these guides 24 can all be installed simultaneously while all the rollers 26 are still in a push position. This facilitates the control of the rollers and guides with respect to what has been described, since all the rollers and all the guides can then be controlled simultaneously. According to an alternative, apertures may be provided in guides 24 so that they can be installed avoiding the rollers, while the rollers are still in a push position.

Plates 21, 22, and guides 24 have been described as rotatable, rollers 26 being fixed. It should be clear that plates 21, 22, and guides 24 could be fixed and rollers 26 rotatable.

Of course, the present invention applies to the case where it is desired to wind several conductors 28 at the same time. The several conductors are then wound at the same time in a same layer.

The present invention is not limited to windings with a circular cross-section. It applies to windings with any cross-section, determined by the movement of guides 24.

What is claimed is:

1. A device for winding coils including a plurality of layers of windings wound around an axis, the layers being radial and wound alternately from an inside to an outside and from the outside to the inside, comprising:

internal and external winding guides distributed in a plane of a layer of windings being wound;

means for enabling the external guides to be retracted from an engaged position with the internal guides so as to follow the external diameter of a layer being wound from the inside to the outside, and the internal guides to be retracted from an engaged position with the external guides so as to follow the internal diameter of a layer being wound from the outside to the inside;

a fixed guiding means to bring a conductor to be wound into the plane of the winding guides and to hold a first surface of the layer being wound; and a shifting mechanism for axially shifting a completed layer into a hopper at a side opposite the guiding means.

2. A winding device according to claim 1, wherein the guiding means and the shifting mechanism include together a plurality of rollers with a radial axis distributed on said first surface of the layer being wound, these rollers being arranged to axially penetrate between the external and internal turning guides to shift a completed layer.

3. A winding device according to claim 1, wherein the hopper includes a plate to support wound layers on a side opposite the guiding means, and axial retraction means for enabling said plate to be axially retracted upon shifting of each completed layer.

4. A device according to claim 1, wherein the conductors have a rectangular cross-section.

5. A device according to claim 4, wherein the main axis of the rectangular cross-section of the conductors is perpendicular to the axis (A) of the coils.

6. A device according to claim 1, wherein the conductors have a circular cross-section, each layer including the same number of windings as the preceding layer and being radially shifted with respect to the preceding layer by one conductor half-diameter.

7. A device according to claim 1, wherein each winding includes several conductors in the plane of the associated layer.

8. A device for winding coils including a plurality of layers of windings wound around an axis, the layers being radial and wound alternately from an inside to an outside and from the outside to the inside, comprising:

internal and external winding guides distributed in a plane of a layer of windings being wound;

means for enabling the external guides to be shifted from an engaged position with the internal guides so as to follow the external diameter of a layer being wound from the inside to the outside, and the internal guides to be shifted from an engaged position with the external guides so as to follow the internal diameter of a layer being wound from the outside to the inside; and, a plurality of rollers to bring a conductor to be wound into the plane of the winding guides, support a first surface of the layer being wound, and axially shift a completed layer.

* * * * *